US010161206B2

(12) United States Patent
Girola

(10) Patent No.: US 10,161,206 B2
(45) Date of Patent: Dec. 25, 2018

(54) METHOD FOR DRILLING A WELL IN CONTINUOUS CIRCULATION AND DEVICE FOR INTERCEPTING AND REDISTRIBUTING FLUID USED IN THIS METHOD

(71) Applicant: HAD ENGINEERING S.R.L., Saronno-Varese (IT)

(72) Inventor: Giorgio Girola, Saronno-Varese (IT)

(73) Assignee: HAD ENGINEERING S.R.L., Saronno-Varese (IT)

( * ) Notice: Subject to any disclaimer, the term of this patent is extended or adjusted under 35 U.S.C. 154(b) by 197 days.

(21) Appl. No.: 15/112,991

(22) PCT Filed: Jan. 9, 2015

(86) PCT No.: PCT/EP2015/000035
§ 371 (c)(1),
(2) Date: Jul. 20, 2016

(87) PCT Pub. No.: WO2015/110251
PCT Pub. Date: Jul. 30, 2015

(65) Prior Publication Data

US 2017/0002615 A1 Jan. 5, 2017

(30) Foreign Application Priority Data

Jan. 21, 2014 (IT) ..... MI2014A0070

(51) Int. Cl.
*E21B 21/10* (2006.01)

(52) U.S. Cl.
CPC ..... *E21B 21/106* (2013.01); *E21B 21/10* (2013.01)

(58) Field of Classification Search
CPC ..... E21B 21/106; E21B 21/10
See application file for complete search history.

(56) References Cited

U.S. PATENT DOCUMENTS

2011/0155379 A1 6/2011 Bailey et al.
2011/0308860 A1 12/2011 deBoer
2013/0068532 A1* 3/2013 Bansal ..... E21B 21/10 175/218

FOREIGN PATENT DOCUMENTS

WO 2008/095650 A1 8/2008

OTHER PUBLICATIONS

International Search Report for PCT/EP2015/000035 dated May 27, 2015.

* cited by examiner

*Primary Examiner* — D. Andrews
*Assistant Examiner* — Kristyn A Hall
(74) *Attorney, Agent, or Firm* — Hedman & Costigan, P.C.; James V. Costigan; Kathleen A. Costigan

(57) ABSTRACT

A method for drilling a well in continuous circulation and a device for intercepting and redistributing fluids for this drilling method wherein said device comprises a main chamber (5) communicating with a first auxiliary chamber (6) and with a second auxiliary chamber (7), in which during the direct drilling flow (F1) mode, said auxiliary chambers (6,7) are placed in fluid communication with each other.

8 Claims, 11 Drawing Sheets

METHOD FOR DRILLING A WELL IN CONTINUOUS CIRCULATION AND DEVICE FOR INTERCEPTING AND REDISTRIBUTING FLUID USED IN THIS METHOD

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM (EFS-WEB)

Not Applicable

STATEMENT REGARDING PRIOR DISCLOSURES BY THE INVENTOR OR A JOINT INVENTOR

Not Applicable

BACKGROUND OF THE INVENTION

The present invention relates to a method for drilling a well in continuous circulation. The invention also relates to the device for intercepting and redistributing fluid used in this method.

(1) Field of the Invention

The field of the invention is the drilling of a well in continuous circulation. In this type of operation, the aim is to maintain a constant flow rate of the drilling fluid circulated inside the well, also during extension of the drill rod, in particular implemented by adding one or more preassembled elements to the string of drill rods.

2) Description of Related Art Including Information Disclosed Under 37 CFR 1.97 and 1.98

For this purpose the use is known of devices for intercepting and redistributing the drilling fluid, comprising a main chamber for entry of this fluid suitable to redistribute, between two separate non-communicating auxiliary chambers, the same intercepted fluid (WO2008/095650). More specifically, one of the aforesaid auxiliary chambers operates exclusively during the well drilling step, while the remaining auxiliary chamber is used only during extension of the drill rod or of the drill string.

The prior art described above mainly has the drawback of allowing the whole drilling fluid flow rate (therefore also high flow rates, for example over 3000 l/min, required for large diameter bores or when bottom hole equipment is present) to pass through only one of the two aforesaid auxiliary chambers. This significantly increases wear on the sections for changing the direction of flow inside the device, making it necessary to carry out maintenance operations that compromise the continuity of the overall drilling procedure. Similar drawbacks occur with the use of high density drilling fluids, which are rich in solids and therefore more erosive.

BRIEF SUMMARY OF THE INVENTION

The main object of the present invention is to provide a device for intercepting and redistributing fluid and related method for continuous circulation drilling, in which the aforesaid problems not encountered.

In particular, an object of the invention is to provide a device of the aforesaid type, which allows wells to be drilled also at high flow rates and/or with highly erosive fluids, while drastically reducing load losses and resulting localized wear.

These and other objects are achieved with the device and with the method of claims 1 and 7 respectively. Preferred embodiments of the invention are set down in the remaining claims.

In relation to the prior art described above, the device and the method of the invention offer the advantage of significantly reducing localized wear on the system for intercepting and redistributing the drilling fluid, through exploitation of auxiliary chambers that are placed in fluid communication with one another and thereby allow even high flow rates, required for wells of larger dimensions and/or wells that use bottom hole equipment, to be sustained.

BRIEF DESCRIPTION OF THE SEVERAL VIEWS OF THE DRAWING(S)

These and other objects, advantages and characteristics will be apparent from the following description of a preferred embodiment of the method and the device of the invention illustrated, by way of non-limiting example, in the figures of the accompanying drawings.

DETAILED DESCRIPTION OF THE INVENTION

Figure 1:
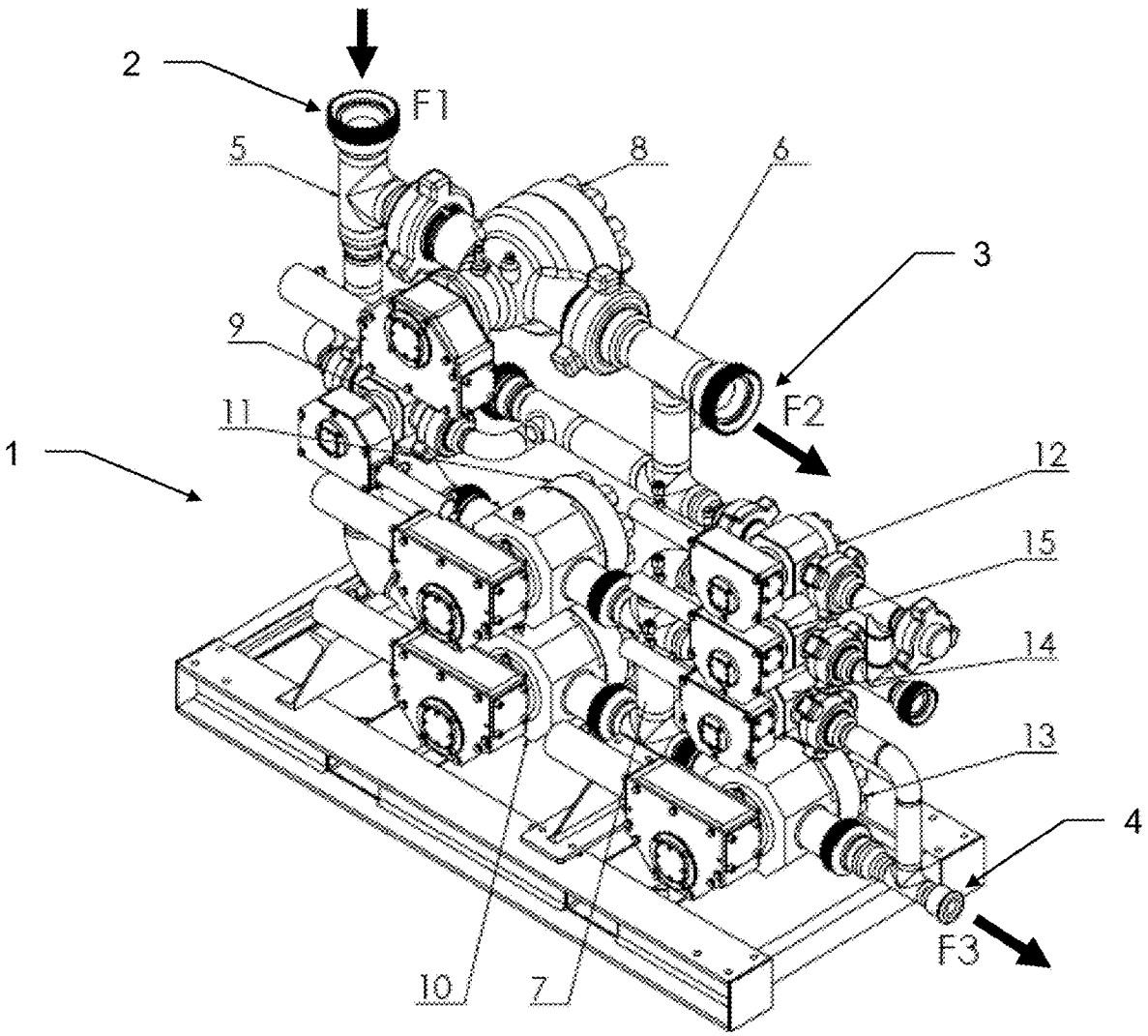
FIG. 1 shows a perspective view of an example of embodiment of the device of the invention.
Figure 2:
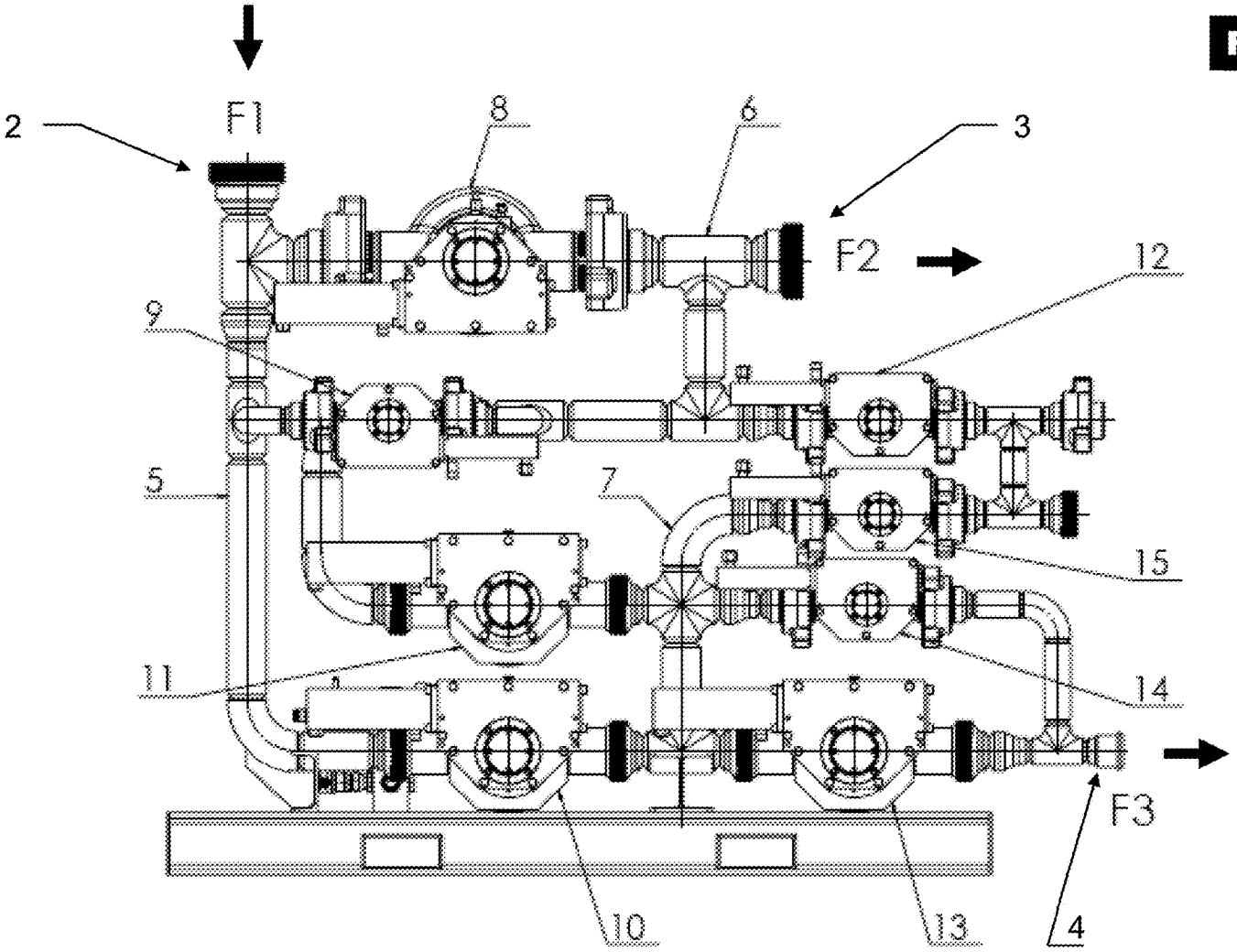
FIG. 2 shows the device of FIG. 1 in a side view.

The device of the invention for intercepting and redistributing drilling fluid in drilling rigs is indicated as a whole with 1 in FIG. 1. This device comprises an inlet 2 for the direct flow F1 of the drilling fluid, an outlet 3 for the flow F2 of the fluid coming from the string of drill rods and an outlet 4 of the radial flow F3 of fluid from the same drill string, during the step to add an extension section to the drill string. The drilling fluid circulating in the device 1 can be mud, water or the like, which is circulated in the device of FIGS. 1 and 2 passing through a main chamber 5, a first auxiliary chamber 6 and a second auxiliary chamber 7, all in fluid communication with one another.

Figure 3:
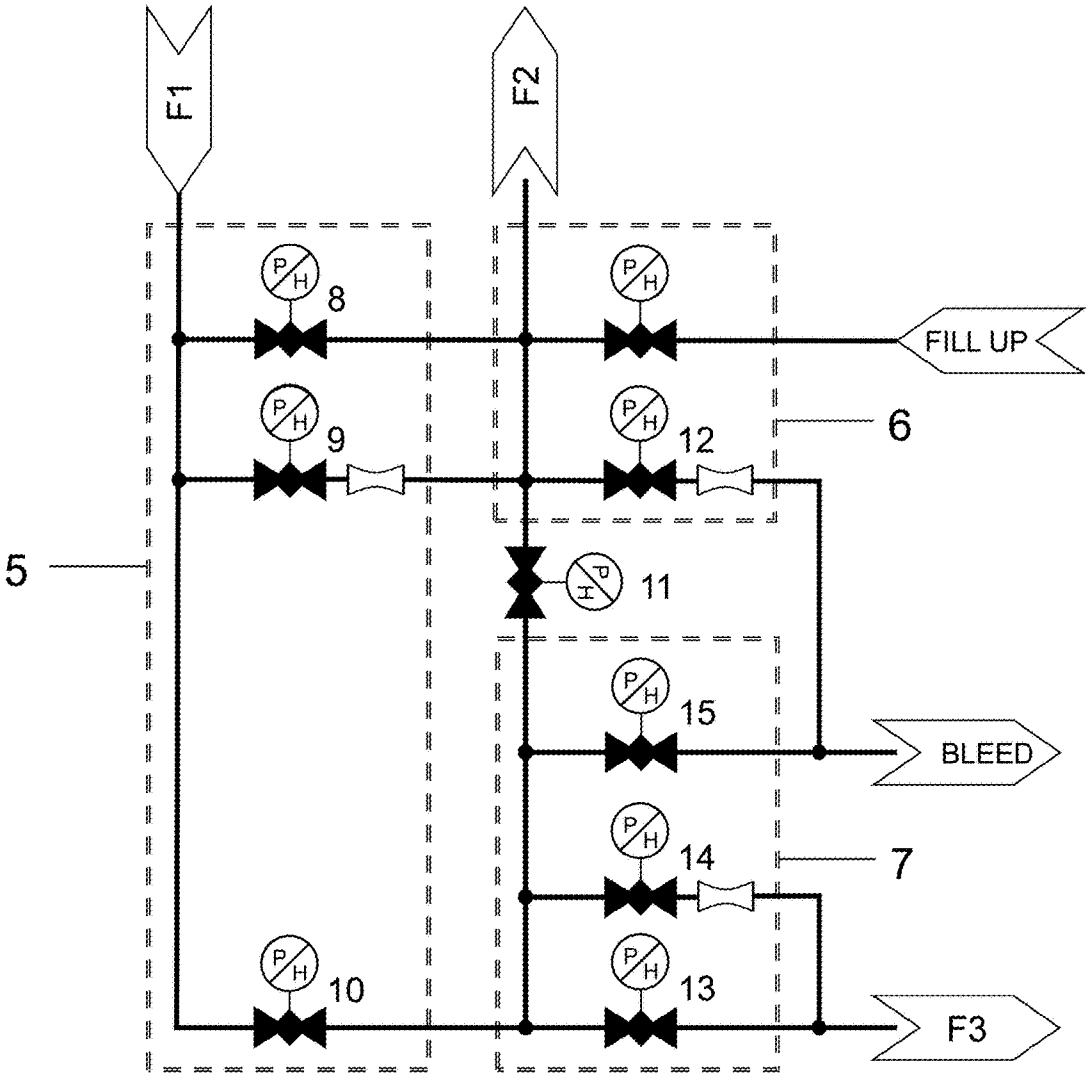
FIG. 3 shows a schematic diagram of the operation of the device of FIG. 1.
Figure 4:
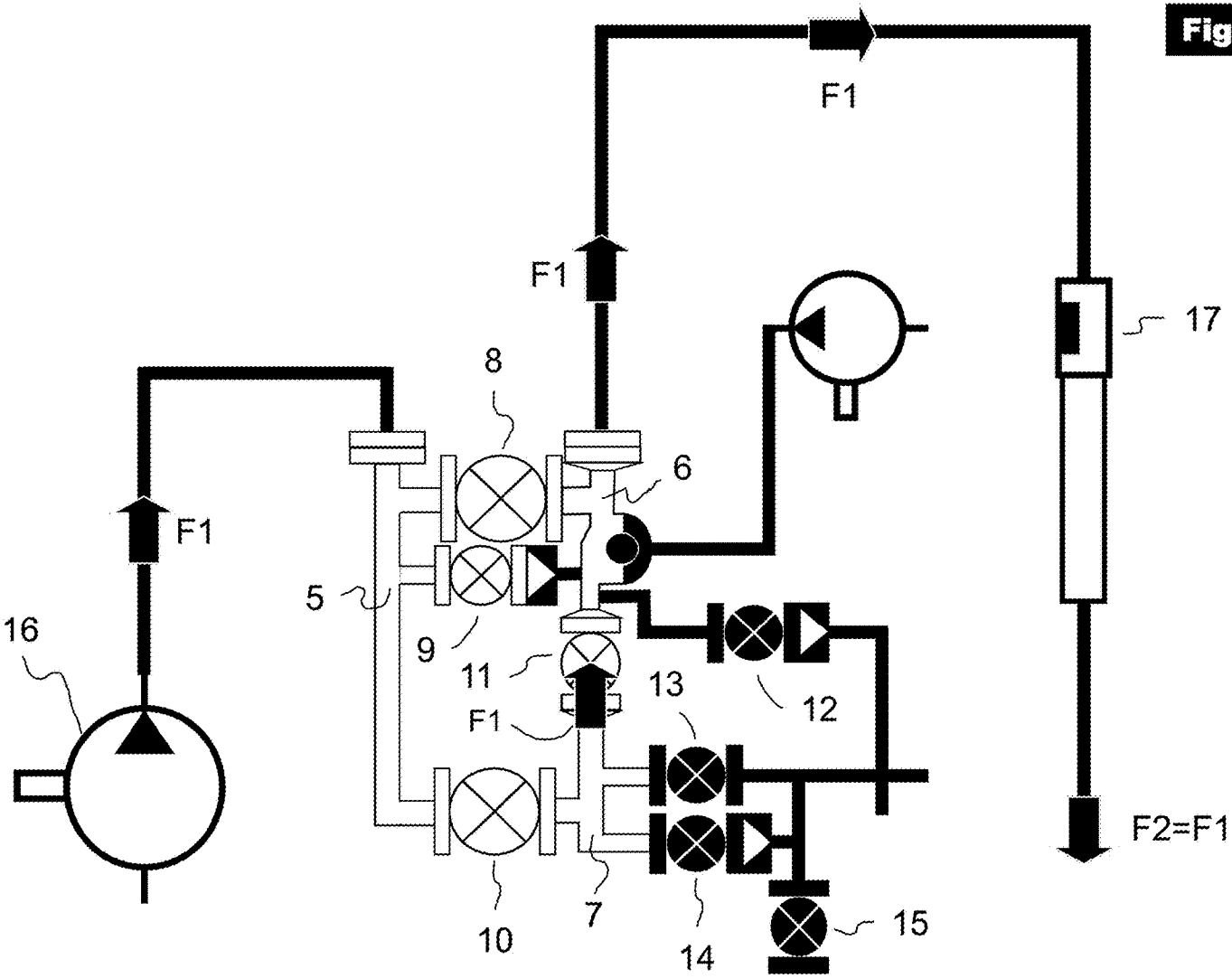
FIG. 4 shows the device of the invention in drilling mode.

As can be seen from the diagram illustrated in FIG. 3, the flow F1 entering the main chamber 5 is transferred to the first auxiliary chamber 6 passing through a flow control valve 8 and a pressure relief valve 9. The same flow F1 coming from the main chamber 5 also enters the second auxiliary chamber 7 passing through the respective flow control valve 10 and is transferred, from this chamber 7 to the first auxiliary chamber 6, passing through the flow control valve 11, which is provided to place the aforesaid auxiliary chambers 6 and 7 in communication. In this way, and in the absence of radial flow F3, a direct flow of drilling fluid F2=F1 is obtained at the outlet from the first auxiliary chamber 6, which is sent to the string of drill rods 17 (FIG. 4). The first auxiliary chamber 6 also has a pressure relief valve 12, while the second auxiliary chamber 7 has a flow control valve 13, a pressure valve 14 and a discharge valve 15.

Therefore the auxiliary chambers 6 and 7 are placed in communication with each other through the valve 11, which allows the drilling fluid to circulate from the second chamber 7 towards the first chamber 6, to then be sent from here to the drilling system.

In direct circulation drilling mode shown in FIG. 4, the device 1 receives the flow F1 of drilling fluid supplied by a suitable piston pump 16, which first sends it to the main chamber 5 and, from here, both to the first auxiliary chamber 6 (passing through both its valves 8 and 9), and to the second auxiliary chamber 7, this time passing through the corresponding valve 10. The flow F1 supplied to the second auxiliary chamber 7 is also transferred inside the first auxiliary chamber 6, passing through the valve 11 that places the aforesaid auxiliary chambers in communication with each other during this drilling step. Therefore, a flow F2, the same as the flow F1 that exits from the first auxiliary chamber 6 of the device of the invention, is sent to the string of drill rods. In this drilling mode with direct circulation of the drilling fluid, the valve 12 of the chamber 6 and the valves 13, 14 of the chamber 7 are all closed.

Figure 5:
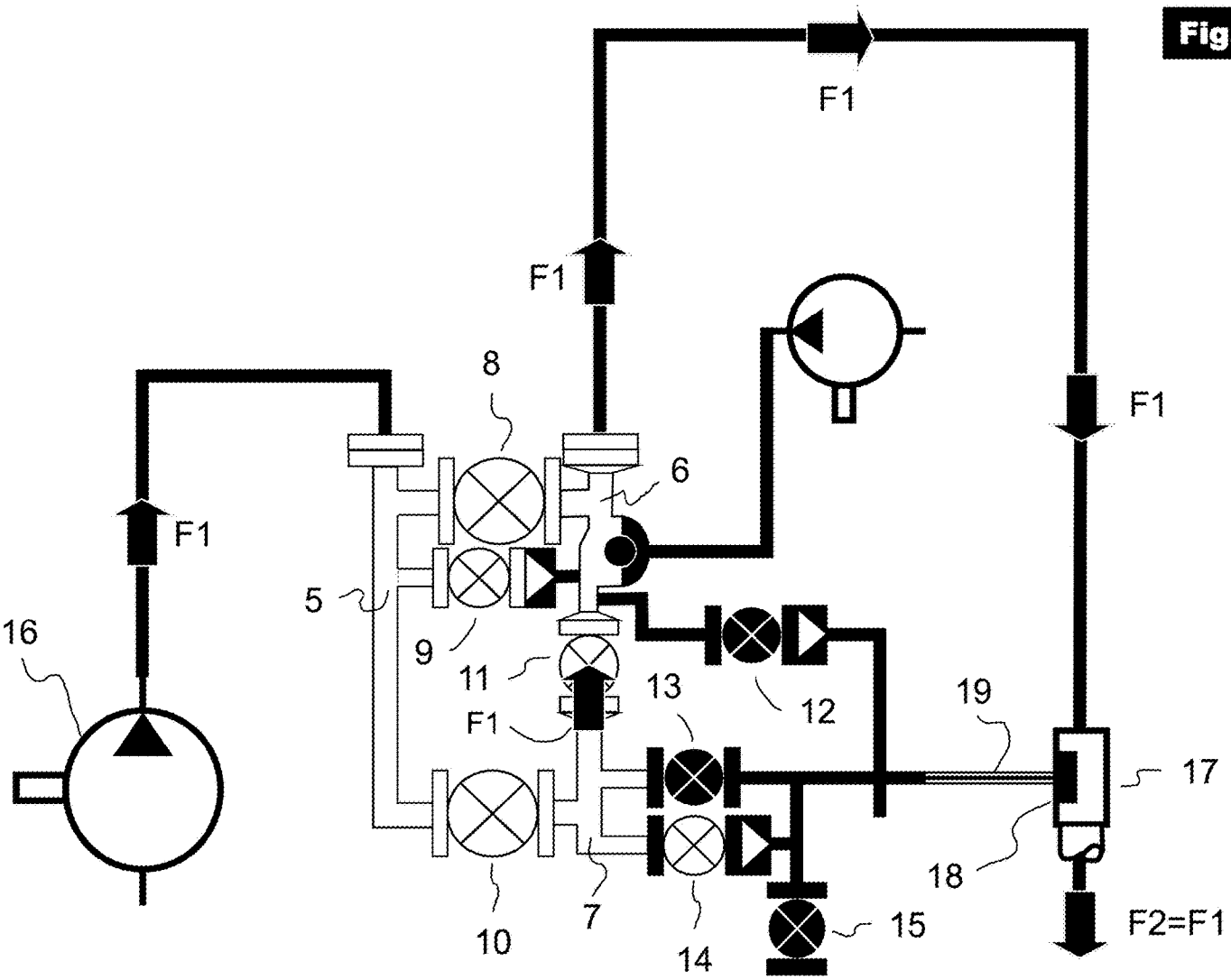
FIG. 5 shows the device of FIG. 4 in pressurizing mode, preliminary to the combined direct and radial flow.

In the operating mode shown in FIG. 5, corresponding to the transient state between the drilling modes and that of extension of the string of drill rods 17, the chambers 5, 6 and 7 are maintained in fluid communication with one another (flow F2=F1 of the previous FIG. 4). However, in this step the pressure valve 14 of the chamber 7 is no longer closed as before, but is open, so as to pressurize the radial channel 19, which places the second auxiliary chamber 7 in fluid communication with the string of drill rods 17 through a respective valve 18.

Figure 6:
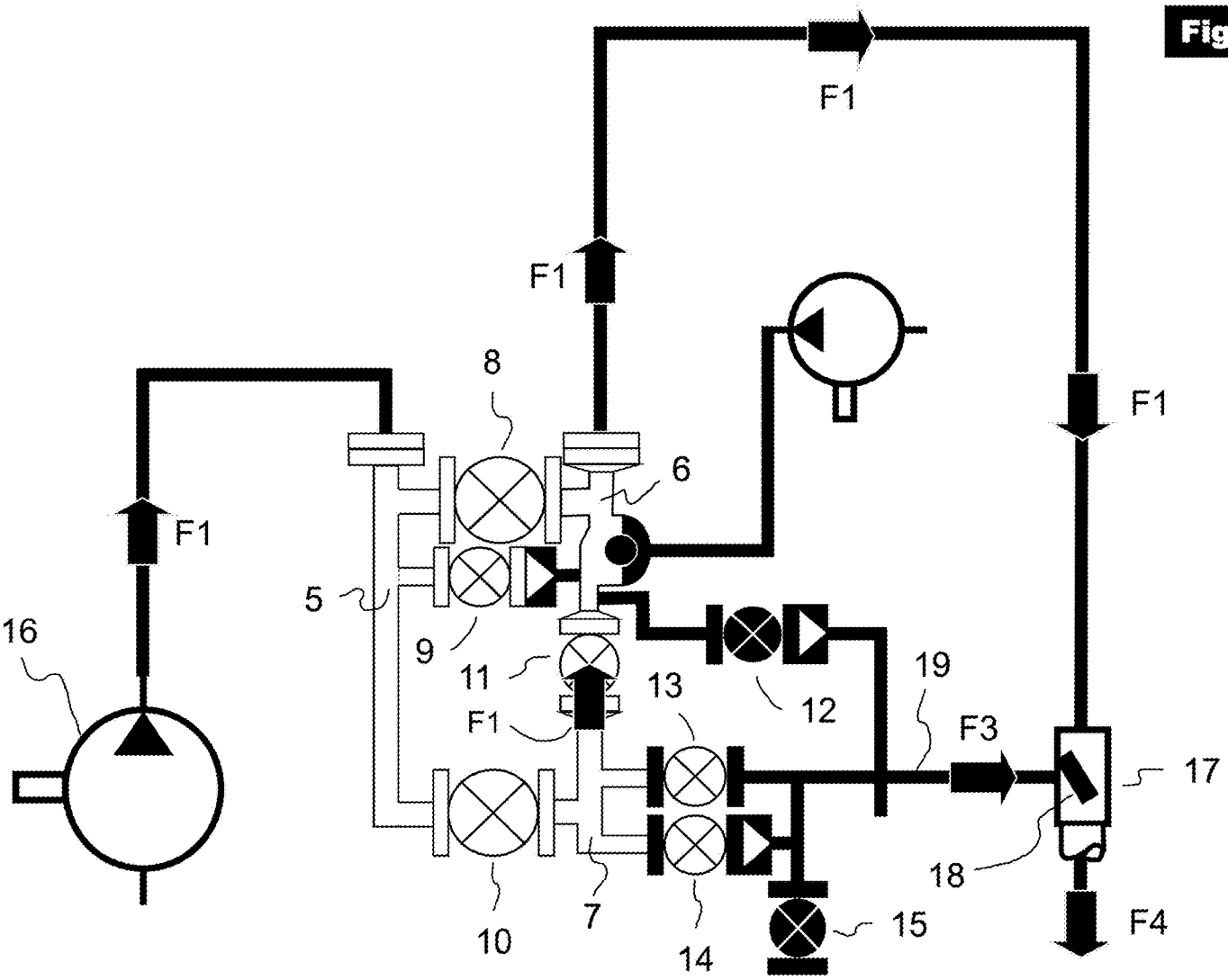
FIG. 6 shows the device of FIG. 5 in combined direct and radial flow mode.

In the subsequent step, shown in FIG. 6, in addition to the valve 14 of the chamber 7, the flow control valve 13 is also open. In this way, a flow F3 is generated through the channel 19 and enters the string of rods 17 radially, passing through the respective valve 18 and producing, together with the flow F1, a flow of drilling fluid F4=F1+F3 corresponding to the placing the system in a state of combined circulation, respectively direct and radial.

Figure 7:
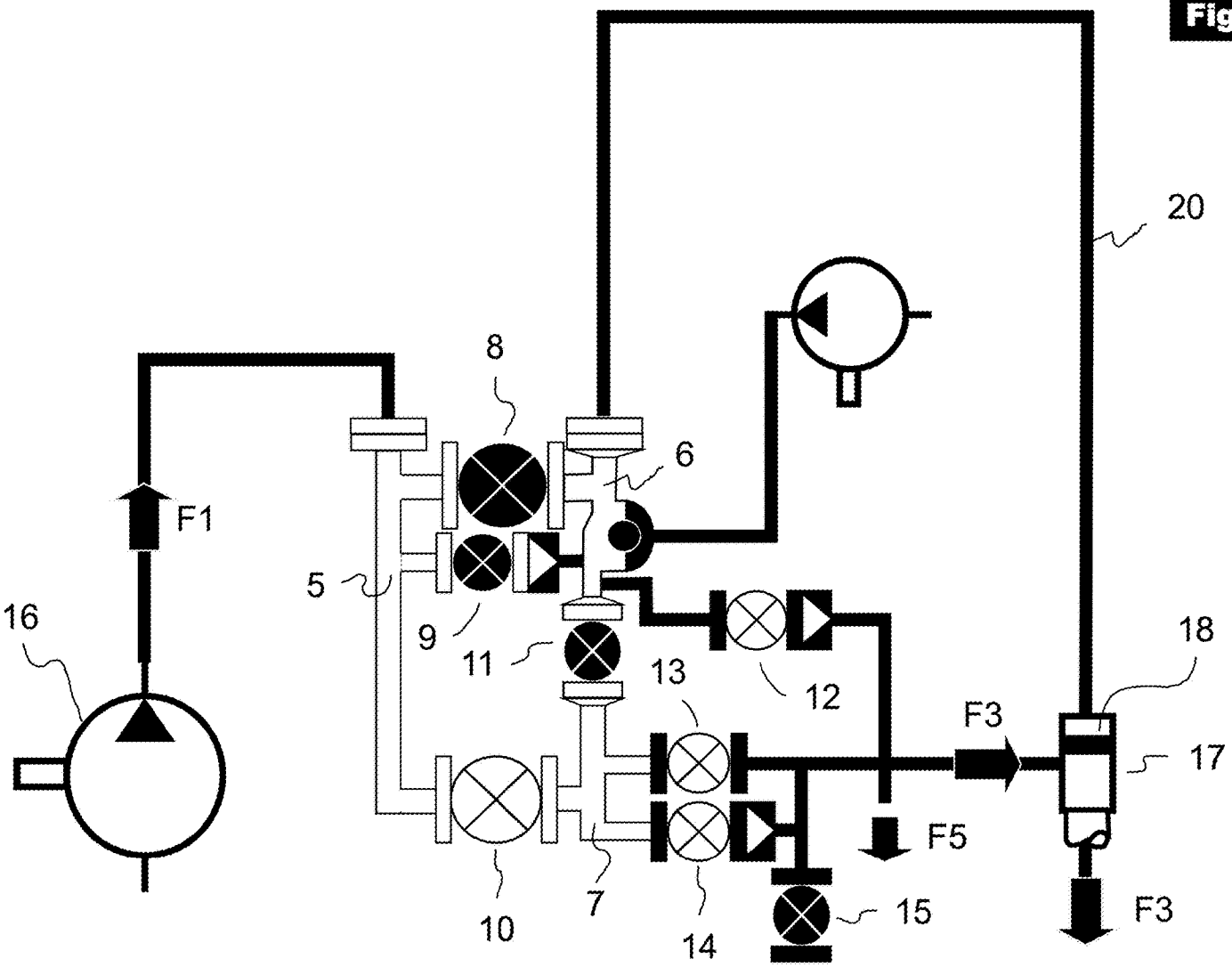
FIG. 7 shows the device of FIG. 6 only in radial flow mode (i.e. in the absence of direct flow)

From this moment, the drilling system is placed exclusively in the radial circulation mode shown in FIG. 7, both by closing the valves 8, 9 and 11, which in this way isolate the first auxiliary chamber 6 from the flow of drilling fluid circulating between the chambers 5 and 7, and by closing the valve 18 to the direct circulation. In these conditions the flow of fluid supplied by the pump 16 is sent first to the main chamber 5, then to the second auxiliary chamber 7 (passing through the respective valve 10), then to the drill string 17 through the valves 13 and 14 (18 is in closed position), generating a radial drilling flow F3.

In order to isolate the direct circulation line 20 of the drilling fluid to the string of rods 17 with respect to the radial flow F3, the valve 12 of the first auxiliary chamber 6 is maintained open. In these conditions the flow F5 of fluid present in the line 20 is discharged towards the outside and, as this line is in depressurized state, it is in turn hermetically closed by the valve 18 placed inside the drill string 17 (FIG. 7). At this point it is possible to add, to the line 20 which has thus been emptied of circulating fluid, a supplementary rod 21 for extension of the drill string 17, also equipped with its own radial valve 22 (FIG. 8).

Figure 8:
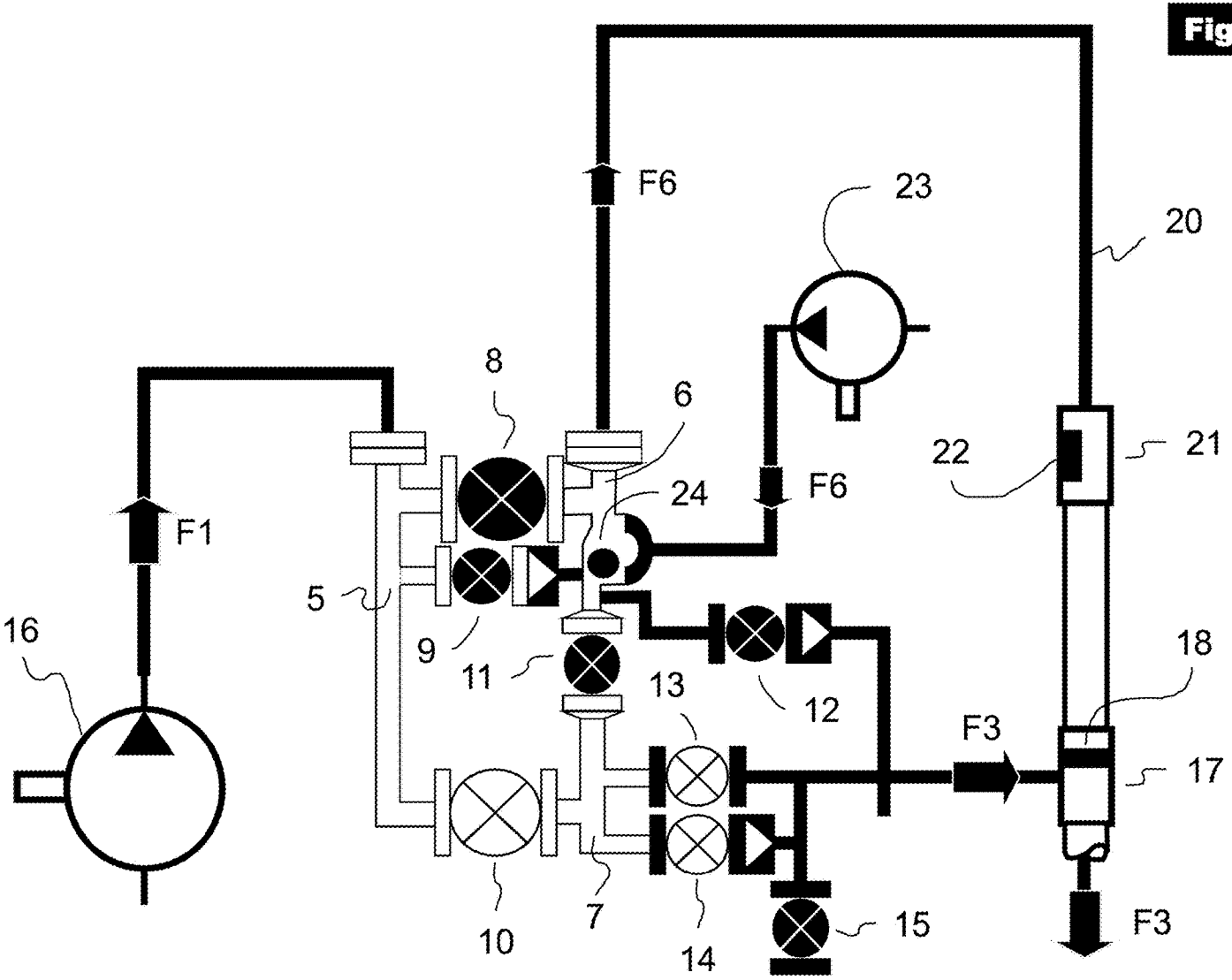
FIG. 8 shows the device of FIG. 7 in which an extension section has been added to the drill string.
Figure 9:
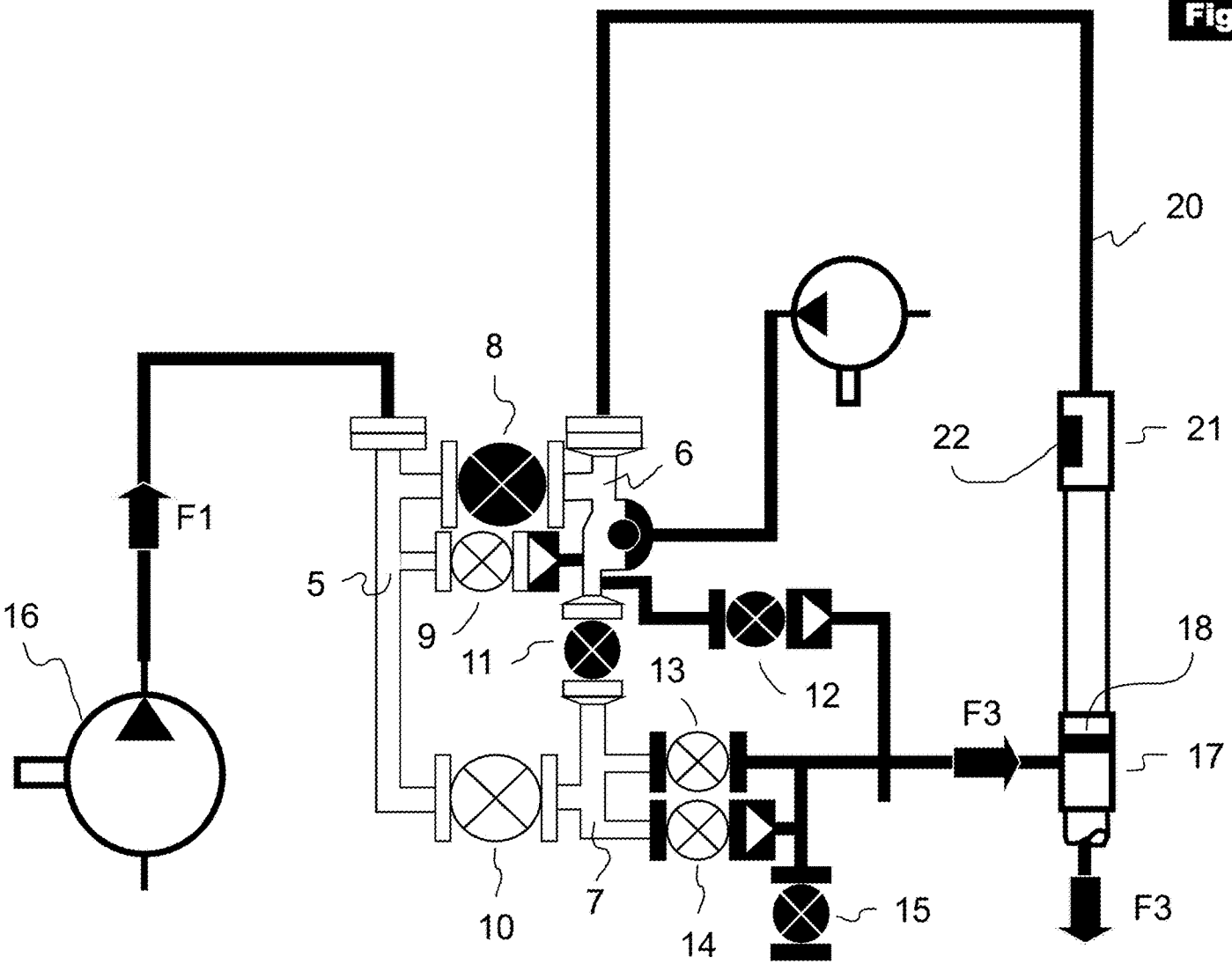
FIG. 9 shows the device of FIG. 8 in the pressure equalization step, preliminary to combined direct and radial circulation.

Before returning to direct circulation mode, and therefore before opening the valve 11 for placing the auxiliary chambers 6 and 7 in communication with each other, the extension rod 21 and the respective supply line 20 are filled with drilling fluid supplied through a filling valve 24 of the first auxiliary chamber 6, by means of a flow F6 generated by a respective pump 23 (FIG. 8). From this moment the valve 24 is closed and the valve 9 is opened, thereby pressurizing the first auxiliary chamber 6, the rod 21 and the respective line 20 of the direct drilling flow (FIG. 9).

Figure 10:
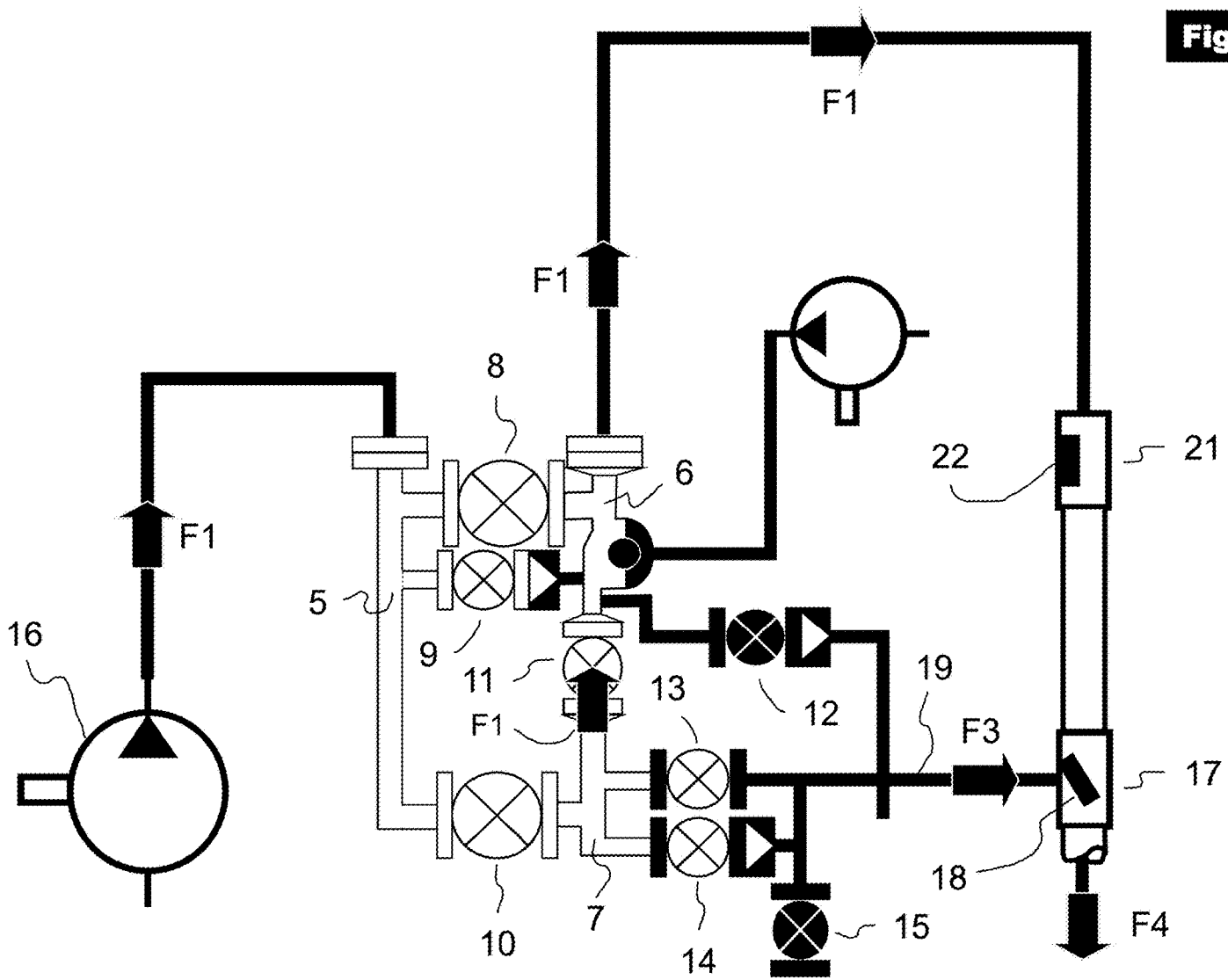
FIG. 10 shows the device of FIG. 9 in the combined circulation step.

In the operating mode shown in FIG. 10 the drilling system returns to the combined circulation step (direct F1 and radial F3) already described with reference to FIG. 6, this time with the string of rods 17 extended through the presence of the respective rod 21.

Figure 11:
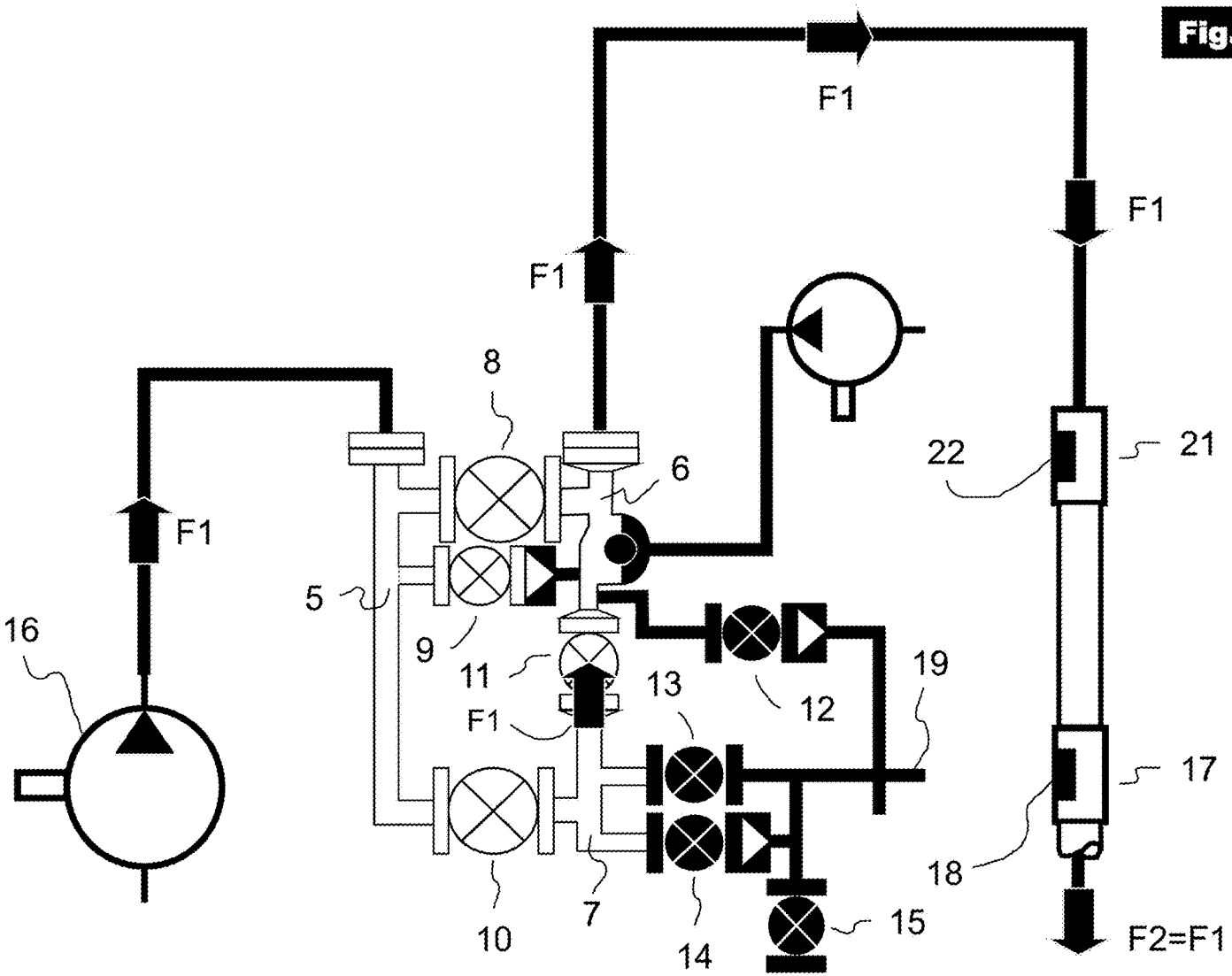
FIG. 11 shows the device of FIG. 10 in the step to restore direct circulation of the drilling fluid.

At this point, it is possible to close the valves 13 and 14 that control the radial flow exiting from the second auxiliary chamber 7 (FIG. 11), thereby restoring the direct circulation shown in FIG. 4. Advantageously, by opening the valve 15 the pressure trapped in the radial channel 19 of this auxiliary chamber 7 is discharged, thereby allowing the aforesaid channel 19 to be disconnected from the rod 17 to restore the direct flow drilling mode.

The invention claimed is:

1. Device for intercepting and redistributing drilling fluid in drilling procedures for drilling a well in continuous circulation of said drilling fluid, produced by means of a direct flow drilling mode (F1) and a radial flow (F3) to a string of drill rods (17), said device comprising a main chamber (5) that communicates with a first auxiliary chamber (6) and with a second auxiliary chamber (7), when said device is in said direct flow drilling mode (F1), said first auxiliary chamber (6) and said second auxiliary chamber (7) are in fluid communication with each other, said device being provided with a valve (11) for placing said first auxiliary chamber (6) and second auxiliary chamber (7) in communication with each other another and said valve (11) is configured to receive said drilling fluid from the second auxiliary chamber (7) and transfer said drilling fluid to said first auxiliary chamber (6) when said device is in said direct flow drilling mode (F1), said main chamber (5) being provided with a first flow control valve (8) and with a pressure relief valve (9) for placing said drilling fluid in communication with said first auxiliary chamber (6), said main chamber (5) also having a second flow control valve (10) for transferring said drilling fluid to said second auxiliary chamber (7).

2. Device according to claim 1, wherein said first auxiliary chamber (6) is provided with a pressure relief valve (12) and with a filling valve (24).

3. Device according to claim 1, wherein said second auxiliary chamber (7) is provided with a flow control valve (13), with a pressure valve (14) and with a discharge valve (15).

4. Method for drilling a well in continuous circulation of drilling fluid carried out with the device according to claim 1 that provides for a direct flow drilling mode (F1) and a radial flow (F3) of fluid to the string of drill rods (17), wherein the direct flow drilling mode (F1) produces a direct circulation of drilling fluid passing through said main chamber (5), said first auxiliary chamber (6) and said second auxiliary chamber (7) of said device, where said main chamber (5), said first auxiliary chamber (6) and said second auxiliary chamber (7) are in communication with one another.

5. Method according to claim 4, wherein said direct flow drilling mode (F1) coming from said second auxiliary chamber (7) is transmitted to said first auxiliary chamber (6), and subsequently sent to said string of drill rods (17).

6. Method according to claim 4, wherein said direct flow drilling mode (F1) is supplied by a respective pump (16) to the said main chamber (5) and from this said main chamber (5) to said first auxiliary chamber (6) and said second auxiliary chamber (7), where said main chamber (5), said first auxiliary chamber (6) and said second auxiliary chamber (7) are maintained in fluid communication both with each other and with said string of drill rods (17).

7. Method according to claim 4, wherein said device is placed in pressurizing and depressurizing modes, prior to starting a combined direct flow drilling mode (F1) and radial (F3) flow of drilling fluid to the string of rods (17), and while in the same mode of combined direct flow drilling mode (F1) and radial (F3) flow, the said direct flow drilling mode (F1) of drilling fluid is produced between said first auxiliary chamber (6) and second auxiliary chamber (7) communicate with each other.

8. Method according to claim 4, wherein, during insertion of a new drilling rod in said string of drill rods (17), and prior to restoring the direct flow drilling mode (F1), the line (20) for supplying drilling fluid to said string of drill rods (17) is filled with said drilling fluid.

* * * * *